US006585260B1

(12) United States Patent
Izawa et al.

(10) Patent No.: US 6,585,260 B1
(45) Date of Patent: Jul. 1, 2003

(54) BILL STACKER WITH AN OBSERVATION WINDOW

(75) Inventors: Hikaru Izawa, Osaka (JP); Noriyuki Kanno, Osaka (JP); Toru Seki, Sagamihara (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 09/856,994

(22) PCT Filed: Oct. 2, 2000

(86) PCT No.: PCT/JP00/06846

§ 371 (c)(1),
(2), (4) Date: Jul. 26, 2001

(87) PCT Pub. No.: WO01/23290

PCT Pub. Date: Apr. 5, 2001

(30) Foreign Application Priority Data

Sep. 30, 1999 (JP) ..... 11-280336

(51) Int. Cl.[7] ..... B65H 29/44
(52) U.S. Cl. ..... 271/207
(58) Field of Search ..... 702/9, 11; 232/10, 232/5; 221/155; 194/350; 109/1 R; 312/190, 191, 183, 61; 271/177, 180, 207, 214

(56) References Cited

U.S. PATENT DOCUMENTS 3,174,608 A * 3/1965 Nickerbocker ..... 221/155
4,067,477 A * 1/1978 Chalabian ..... 221/155
4,332,348 A * 6/1982 Nordin ..... 271/180
4,452,390 A * 6/1984 West ..... 902/9
4,718,532 A * 1/1988 Chalabian ..... 194/350
4,790,476 A * 12/1988 Tanaka et al. ..... 232/1 D
4,798,316 A * 1/1989 Martin et al. ..... 232/1 D
4,913,341 A * 4/1990 Bachman ..... 232/1 D
5,344,135 A * 9/1994 Isobe et al. ..... 271/180
5,372,361 A 12/1994 Isobe et al.
5,388,817 A * 2/1995 Chang ..... 271/180
5,509,646 A * 4/1996 Chang ..... 271/177
5,536,472 A * 7/1996 Terashima et al. ..... 221/279
5,620,079 A 4/1997 Molbak
5,641,157 A * 6/1997 Mays et al. ..... 271/214
5,899,452 A * 5/1999 Walsh ..... 271/180

FOREIGN PATENT DOCUMENTS

| | | |
|---|---|---|
| EP | 0 852 279 A2 | 7/1998 |
| EP | 0 981 116 A2 | 2/2000 |
| GB | 2 088 611 A | 6/1982 |

* cited by examiner

*Primary Examiner*—Donald P. Walsh
*Assistant Examiner*—Kenneth W Bower
(74) *Attorney, Agent, or Firm*—Bachman & LaPointe, P.C.

(57) ABSTRACT

The bill stacker is provided which comprises an encasement 50*b* for forming a compartment 51 for storing bills therein; a cover 52 provided in the encasement 50*b*; and a window 70 for visual observation of a bill stacked in the compartment 51 without unlocking the cover 52. The window 70 can allow to visually and rapidly observe and confirm the denomination of a bill at the top of the compartment 51 by a clerk and a user without unlocking the stacker.

9 Claims, 12 Drawing Sheets

BILL STACKER WITH AN OBSERVATION WINDOW

DESCRIPTION

1. Field of the Invention

The present invention relates to a stacker for storing bills, in particular, of the type wherein a lastly stored bill is visually observable from the outside of the stacker without unlocking the stacker.

2. Background of the Invention

There are various kinds of gaming machines installed in gambling accommodations, such as casinos so that the machines can be operated by the invested bills or tokens for the machines. Each gaming machine is equipped with a coin selector and a bill validator for checking authenticity of coin or tokens and bills inserted into the gaming machine. When the coin selector detects a true coin inserted or when the bill validator detects a true bill inserted, the gaming machine indicates on the display the number of BET corresponding to the amount of money charged.

When a user of the gaming machine suspects that the displayed amount of money or the BET number of the gaming machine is different from or unequal to the amount of money charged, the person asks a clerk in the casino to confirm whether the indication on the display is correct or incorrect. Every time users require, the clerk in charge must unlock locking devices of the gaming machine, open the door, take out the stacker from the gaming machine, and further unlock locking devices of the bill stacker to compare the lastly accumulated bill in the stacker with the indicated amount of money or BET value on the display. In this case, the clerk must show the user the bill stored at the top in the stacker for identification of the bill denomination. Also, the clerk must expose all the bills or a large amount of money used in the stacker to people around the gaming machine to show the user the bills in the stacker. Obviously, this means a very serious problem from the security viewpoint of the exposed bills. Also, in most cases, the access to the stacker in the gaming machine necessarily requires utilization of more than two kind of different keys usually had by different custodians who are summoned to the site each time users request. In fact, such request by users to confirm the once stacked bill in stackers reaches approximately ten times every day per shop, and therefore, the visual confirmation of the inserted bill is troublesome for the casinos.

An object of the present invention is to provide a bill stacker which allows to visually and easily observe the denomination of a bill stored in the stacker from the outside without unlocking the stacker.

DISCLOSURE OF THE PRESENT INVENTION

The bill stacker according to the present invention comprises an encasement (50*b*) for forming a compartment (51) to store bills (1) therein; a cover (52) provided in the encasement (50*b*); and a window (70) provided in the encasement (50*b*) or cover (52) for visual observation of the bill (1) stacked at the top in the compartment (51) without unlocking the cover (52). The window (70) can allow to visually and rapidly observe and confirm the denomination of a bill at the top of the compartment (51) by a clerk and a user without unlocking the stacker. The term "a bill" and "bills" used herein includes a bank note or bank notes, currency, paper money and any other valuable papers.

In an embodiment of the present invention, the stacker may further comprises at least a spring (56) for resiliently urging the bill toward the rest position; a shifting means (72, 73) for moving bills accumulated in the compartment (51) away from the rest position against resilient force of the spring (56); and a hole means (71) for allowing the shifting means (72, 73) to move the bills from the outside of the encasement (50*b*). The manipulation of the shifting means (72, 73) can adjust the vertical level of the accumulated bills (1). Accordingly, although the stacker has its structure wherein the top bill in the compartment (51) cannot directly be observed from the window (70), the bills in the compartment (51) are movable from the rest position toward the compacted position against the resilient force of the spring (53) by applying an external force on the shifting means (72, 73) to show the denomination of the top bill for visual observation of the periphery of the bill.

Otherwise, the stacker may further comprises a pusher (30) disposed in the encasement (50*b*) for squeezing the bill into the compartment (51). The pusher (30) comprises a pushing plate (32) movable between the retracted position and the extended position. The pushing plate (32) has its length shorter than the length of the bill and its width shorter than the width of the bill to show a periphery of the top bill stacked in the compartment (51) out of the circumference of the pushing plate (32) when the pushing plate (32) is in contact with the top bill in the compartment (51). Accordingly, the clerk and user can confirm the denomination of the bill on the top in view of the periphery of the top bill out of the circumference of the pushing plate (32) in the rest position or moved position away from the rest position.

The pusher (30) comprises a pusher driver (30*a*) for moving the pushing plate (32) from the retracted position to the extended position to squeeze into the compartment (51) a paper conveyed in the encasement (50*b*) through an opening (50*a*).

A transparent member (74) is attached to the window (70) to observe the top bill from the outside of the encasement (50*b*) through the transparent member (74).

The shifting means (72) is a rod or bar which can be inserted from the outside through the hole means of a perforation (71) formed in the encasement (50*b*). The shifting means (73) is a handle (73) which has an inner end connected to the pushing plate (32), and an outer end protruding to the outside of the encasement (50*b*) through the hole means of a perforation (71). A backing plate (54) may be provided between the spring (56) and bills (1) so that the shifting means (73) is a handle which has an inner end connected to the backing plate (54) and an outer end protruding out of the encasement (50*b*) through the hole means (71) of a perforation.

An one-way clutch device is provided in the pusher (30) to carry out manual operation of the shifting means (72, 73) so that the bill is moved away from the rest position together with the shifting means (72, 13). Accordingly, the pushing plate (32) can manually be urged away from the rest position for visual confirmation without any obstacle by a drive mechanism for the pusher (30) including for example gears, rollers, and link members. When the locking means (75) is attached above the window (70) due to requirement in design, the window (70) is formed with the transparent member (74) vertically away from the locking means (75) provided in a cover (52) of the encasement (50*b*). However, the bill (1) at the top can be well visually confirmed through the window (70), by moving the bill (1) away from the rest position by the shifting means (72, 73).

The pushing plate (32) is formed with an opening (76) in alignment with the hole means (71) through which the shifting means (72) can be extended to move the bills away from the rest position without movement of the pushing plate (32) by the shifting means (72) passing through the hole means (71) and opening (76).

BEST MODE FOR EMBODIMENT OF THE INVENTION

Embodiments according to the present invention will be explained hereinafter with reference to FIG. 1 to FIG. 11.

Figure 1:
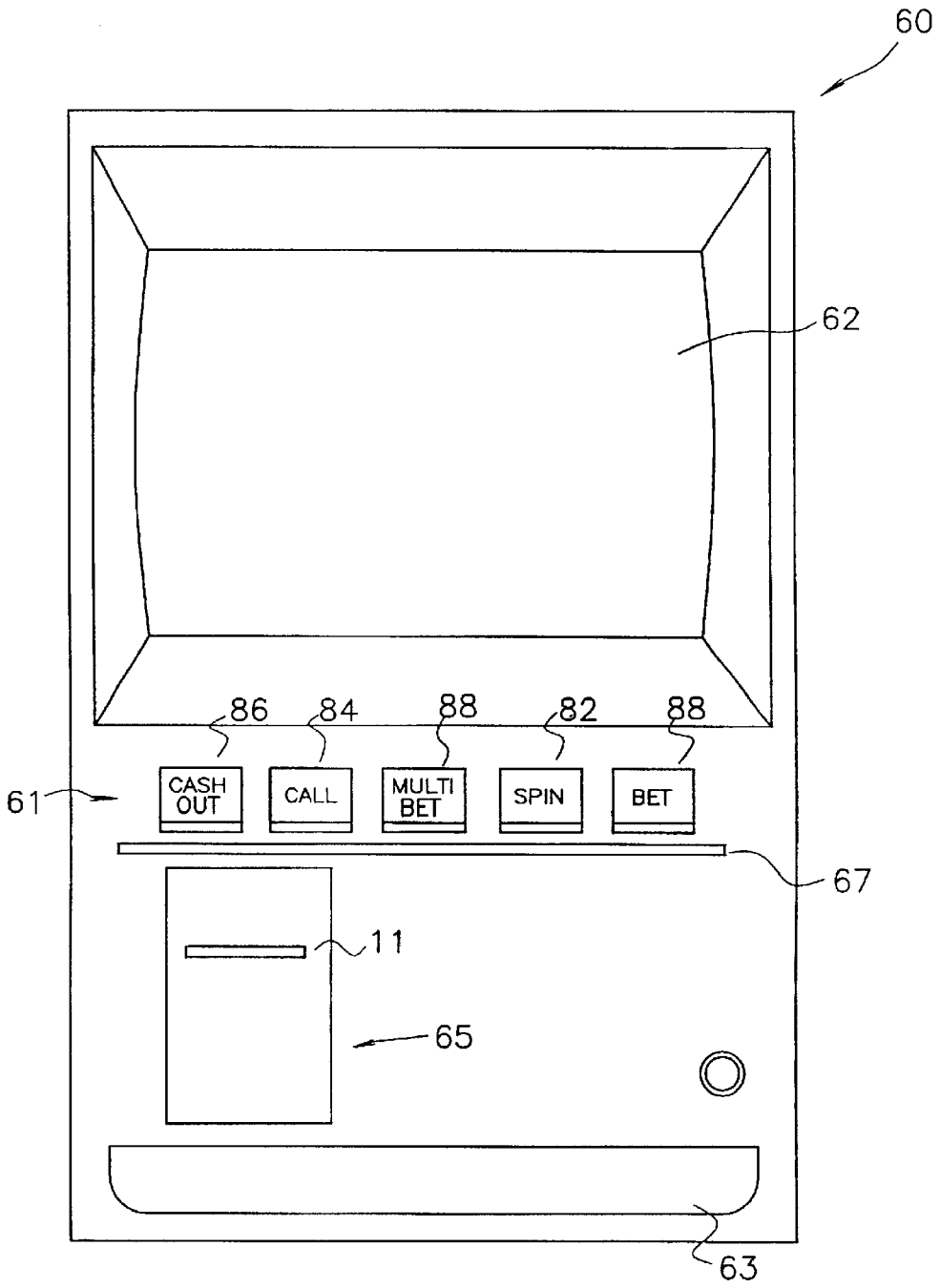
FIG. 1 is a front view of a gaming machine with a bill stacker according to the present invention.
Figure 2:
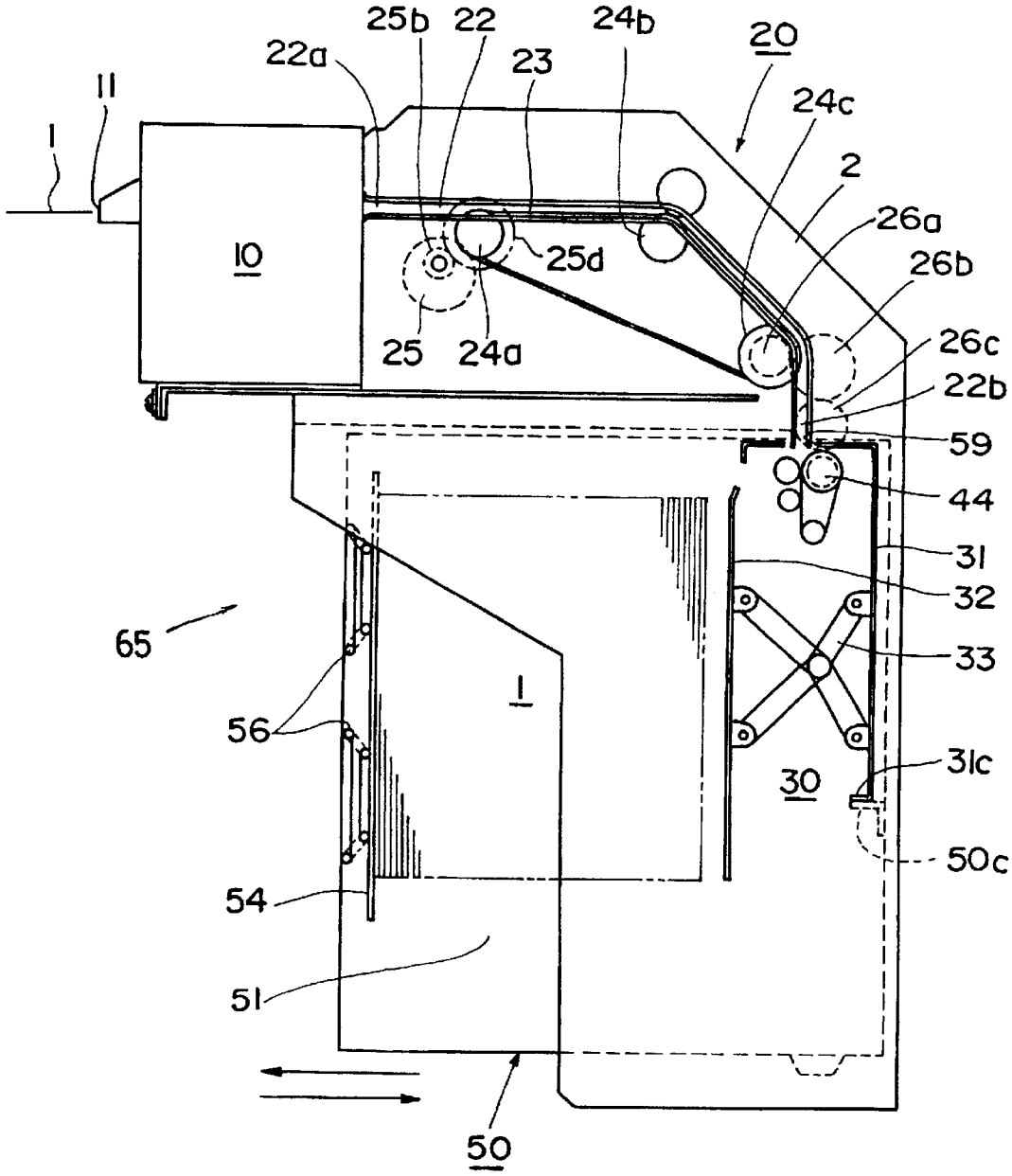
FIG. 2 is a cross-sectional view showing an embodiment of a bill handling apparatus provided in the gaming machine illustrated in FIG. 1.

As shown in FIG. 1, a gaming machine 60 comprises a display 62, a pushbutton panel 61, a game control circuit 67 diagrammatically shown, a bill handling apparatus 65 and a payout tray 63 for discharging bills 1 or coins therein by operation of the pushbutton panel 61 by the user. The display 62 represents development and result of the game, amount of money invested, the BET number and other information necessary for user's operation. The pushbutton panel 61 has a "PLAY" or "SPIN" button 82 for initiating the game, a "CALL" button 84 for calling a clerk in the event of trouble occurrence, a "CASH OUT" button 86 for making payment for a win game and "BET" and "MULTI BET" buttons 88 for setting the bet to be allotted to particular games from the amount of money charged. The game control circuit 67 has software programs for playing and controlling the game for users. The bill handling apparatus 65 comprises a validator 10 electrically connected to the game control circuit 67 for validating a bill 1 inserted into the validator 10 by a user before starting the game; a bill stacker 50 as shown in FIG. 2. The game control circuit 67 is connected to a host computer (not shown) which collectively controls the data for each gaming machine 60.

FIG. 2 shows a cross-sectional view of an embodiment of the bill handling apparatus 65 which comprises a metallic frame 2; the validator 10 attached to the frame 2 for identifying the authenticity or denomination of a bill or paper currency inserted therein; a conveying device or conveyer 20 provided in the frame 2 for conveying the bill 1 supplied from the validator 10 along a passageway defined by guide members 22; a stacker 50 detachably attached to the frame 2 for storing in a compartment 51 the bills 1 traveled from the conveyer 20; and a pushing device or pusher 30 provided in the stacker 50 in operative connection with the conveyer 20 to obtain drive force for squeezing the bill 1 into the compartment 51. The bill stacker 50 can be attached to the frame 2 from the left side in FIG. 2.

In the bill handling apparatus 65 of FIG. 2, the validator 10 is provided with an inlet 11 at the front side for receiving a bill and an inner passageway (not shown) therein following the inlet 11. An exit of the passageway in the validator 10 is communicated with a connecting end 22*a* of the passageway formed by the guide members 22 of the conveyer 20. A rear end 22*b* of the passageway is connected with the stacker 50 removably housed for sliding movement in the frame 2. The validator 10 includes a detecting means not shown for detecting magnetic and optical properties of the bill from ingredients of printed inks, paper quality and the colors thereof to determine whether or not it is genuine.

As shown in FIG. 2, mounted in the frame 2 is the conveyer 20 with the transport guide 22 communicated to the passage outlet in the validator 10 at the connection end 22*a*. The rear end outlet 22*b* of the transport guide 22 is connected to the bill stacker 50. An endless transport belt 23 extends along the transport guide 22 and is wound around a plurality of pulleys 24*a* to 24*c* to convey the bill 1 along the passageway of the guide members 22. Therefore, the bill 1, which has been passed through the validator 10, is then transported through the passageway within the conveyer 22 by the endless belt 23 and then goes toward the stacker 50. Optical sensors (not shown) are provided to detect passage of the bill 1 through the validator 10 and produce a detection signal to the CPU to start rotation of a motor 25 in one direction. The motor 25 of driving source operates the endless belt 23 by operating signals supplied thereto from a CPU provided in the validator 10. The rotation of the motor 25 is transmitted to the pulley 24*a* mounted on a shaft 25*c* via a gear 25*d* engaged with a gear 25*b* mounted on a shaft 25*a* of the motor 25 to drive the conveying belt 23 by the pulley 24*a*.

Figure 3:
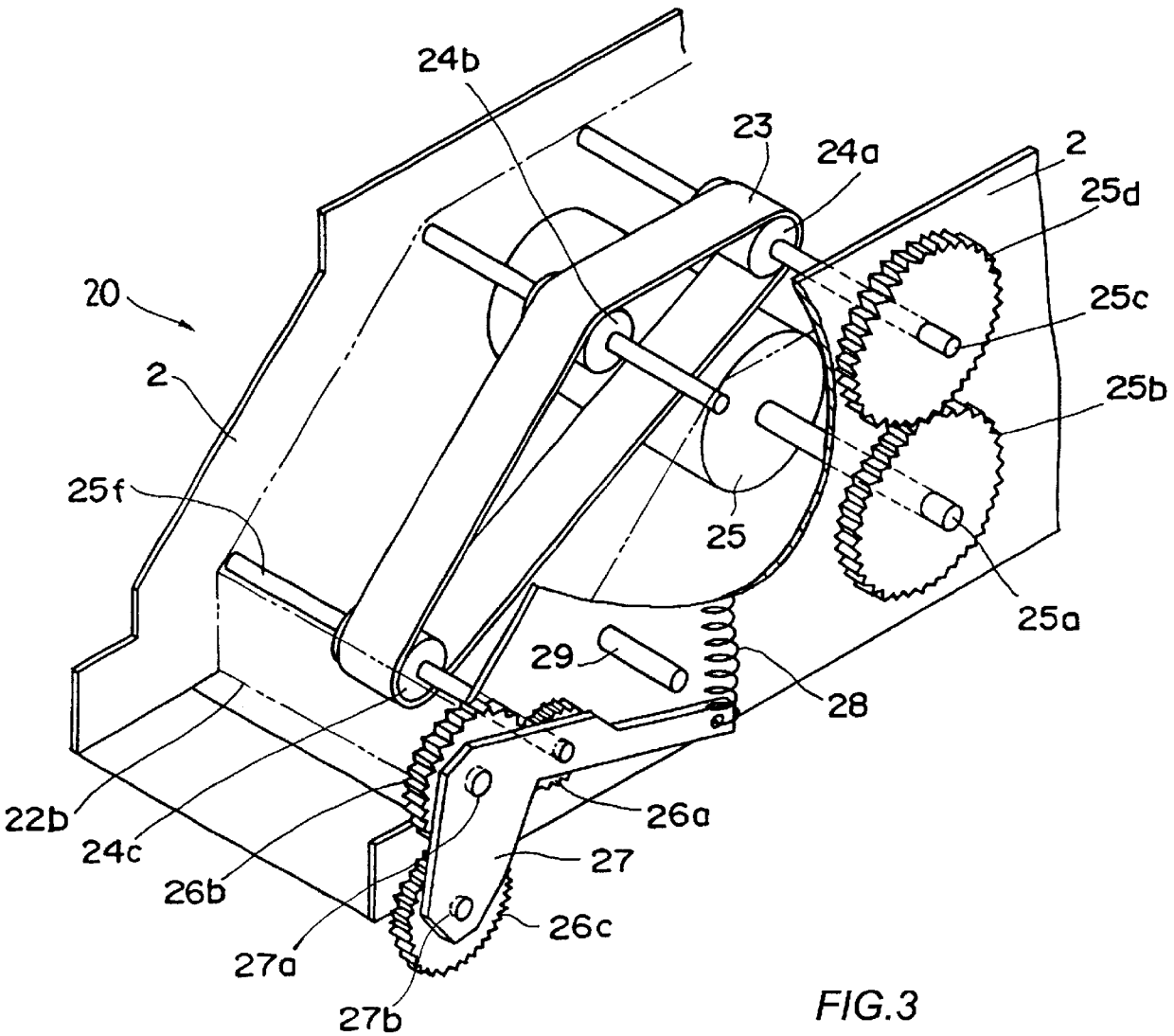
FIG. 3 is a perspective view of a driving mechanism of a conveyer provided in the bill handling apparatus of FIG. 2.

As shown in FIG. 3, a drive gear 26*a* is mounted for rotation on a shaft 25*f* of the pulley 24*c* around which the endless .belt 23 is wound. The shaft 25*f* also supports a gear bracket 27 for rotation in addition to the drive gear 26*a* which is meshed with a middle gear 26*b* engaged with an end gear 26*c* for reduction to necessary rotational rate. These middle and end gears 26*b* and 26*c* are supported for their rotation by pins 27*a*, 27*b* on the gear bracket 27 so that the middle and end gears 26*b*, 26*c* can be rotated by themselves and swayed together with the gear bracket 27 around the shaft 25*f*. One end of a shock absorbing spring 28 is attached to an extremity of the gear bracket 27 and the other end of the shock absorbing spring 28 is fixed to the frame 2 (not shown). Usually, the extremity of the gear bracket 27 is in contact with a stopper pin 29 to prevent its further rotation. However, the gear bracket 27 is rotatable in the clockwise direction around the shaft 25*f* against elastic tensile stress of the shock absorbing spring 28.

Figure 5:
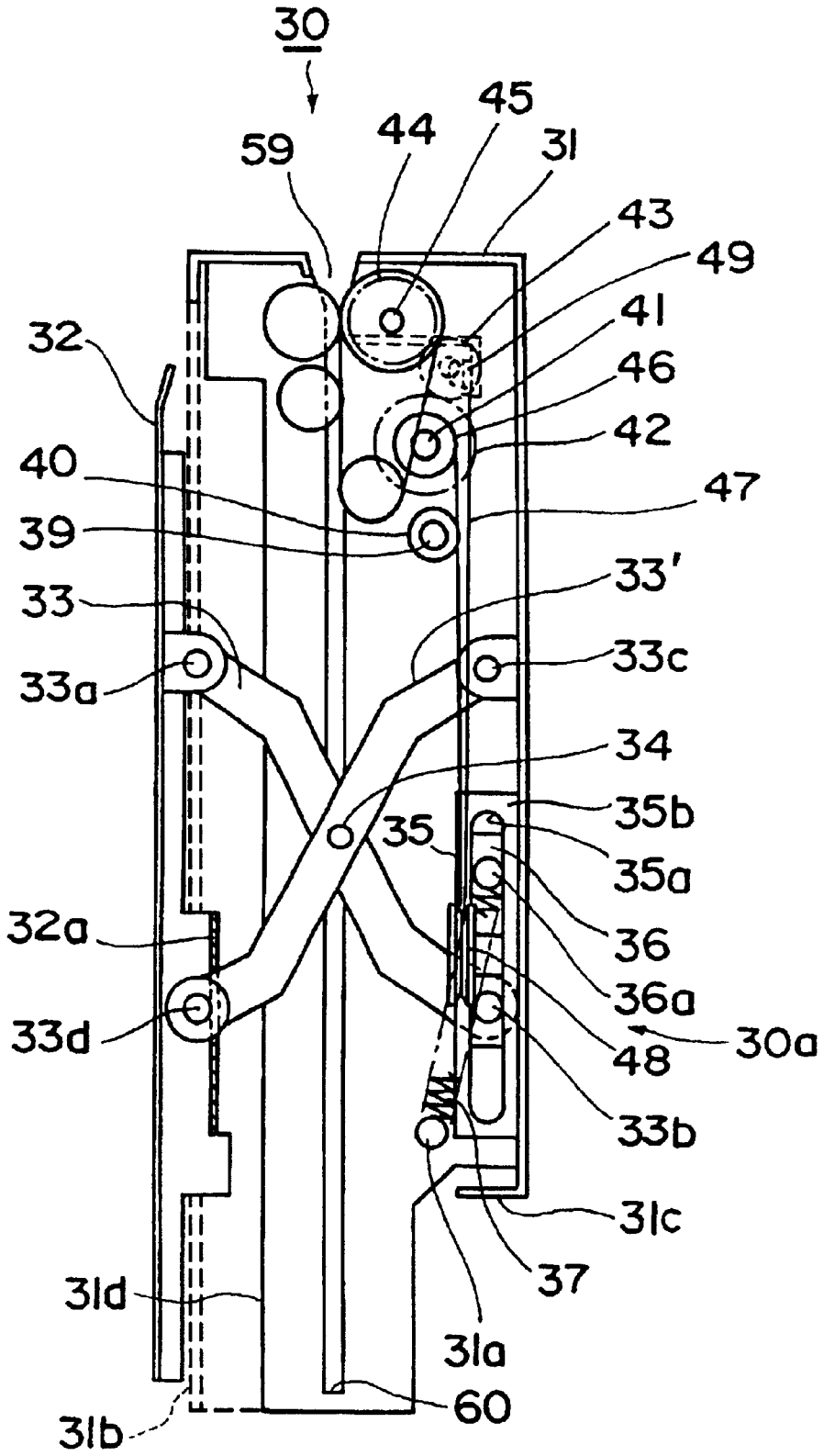
FIG. 5 is a cross-sectional view of the pusher.

The end gear 26*c* is brought into engagement with a passive gear 44 shown in FIGS. 2 and 5 when the stacker 50 is inserted into the frame 2 for incorporation with the conveyer 20 after the pusher 30 is disposed within the stacker 50. When the end gear 26*c* contacts the passive gear 44, produced between these gears 26*c* and 44 is impact force which is absorbed by elastic tensile force of the stock absorbing spring 28 at the time of rotation of the gear bracket 27 around the shaft 25*f* to establish smooth engagement between the middle gear 26*c* and the passive gear 44.

However, when the stacker 50 is removed from the frame 2, the end gear 26*c* is disengaged from the passive gear 44.

Figure 4:
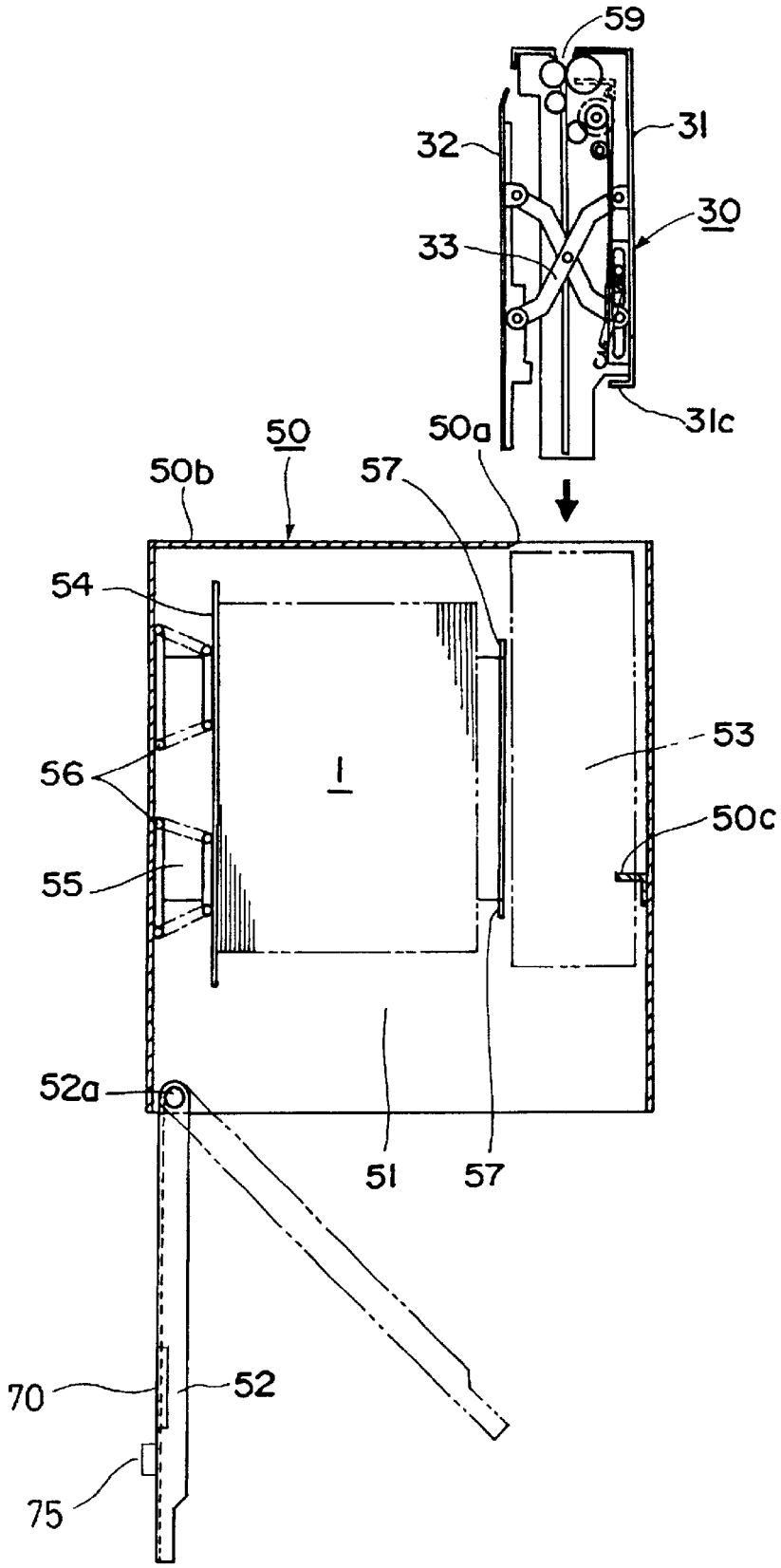
FIG. 4 is a cross-sectional view of a stacker and a pusher attached thereto.

As shown in FIG. 4, a box-shaped encasement 50*b* of the stacker 50 is provided with an opening 50*a* through which the pusher 30 may be placed in or removed from a chamber 53 within the encasement 50*b*. Also, the encasement 50*b* has, adjacent to the chamber 53, a compartment 51 to receive and stores bills. The pusher 30 is located within the chamber 53 in position when a bent portion 31*c* of a base plate 31 of the pusher 30 is in contact with a stopper 50*b* of the encasement 50*b*. The pusher 30 may preferably be secured within the encasement 50*b* by means of a screw (not shown).

As shown in FIG. 5, the pusher 30 has the base plate 31 formed with a slit-shaped inlet 59 and a pushing plate 32, and a pusher driver 30*a* which pushes through the inlet 59 into the compartment 51 the bill 1 transported from the outside of the encasement 50*b* to the inside of the encasement 50*b*.

Figure 6:
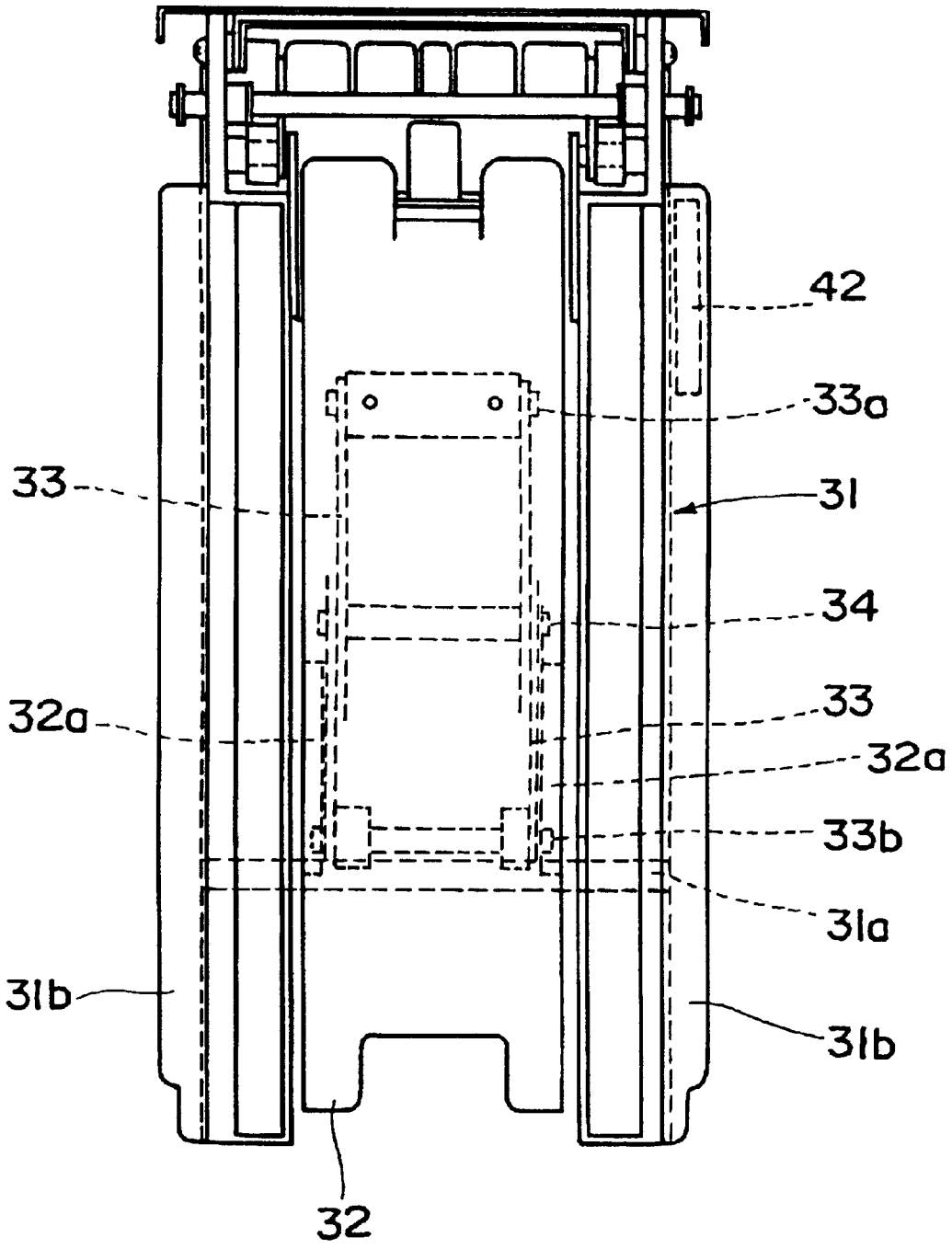
FIG. 6 is a plan view of the pusher.

The pushing plate 32 may be moved away from and toward the base plate 31 in parallel relation via two pairs of two link members 33, 33' which are hingedly connected with each other in "X" shape by an axle 34 passing through each center portion of these link members 33, 33'. FIG. 6 indicates the link members 33, 33' substantially symmetrically provided on each side of the pusher 30. Shafts 33*a* to 33*d* are utilized to hingedly connect each end of the link members 33, 33' with the base plate 31 and the pushing plate 32 to cause parallel movement of the pushing plate 32 relative to the base plate 31.

Figure 7:
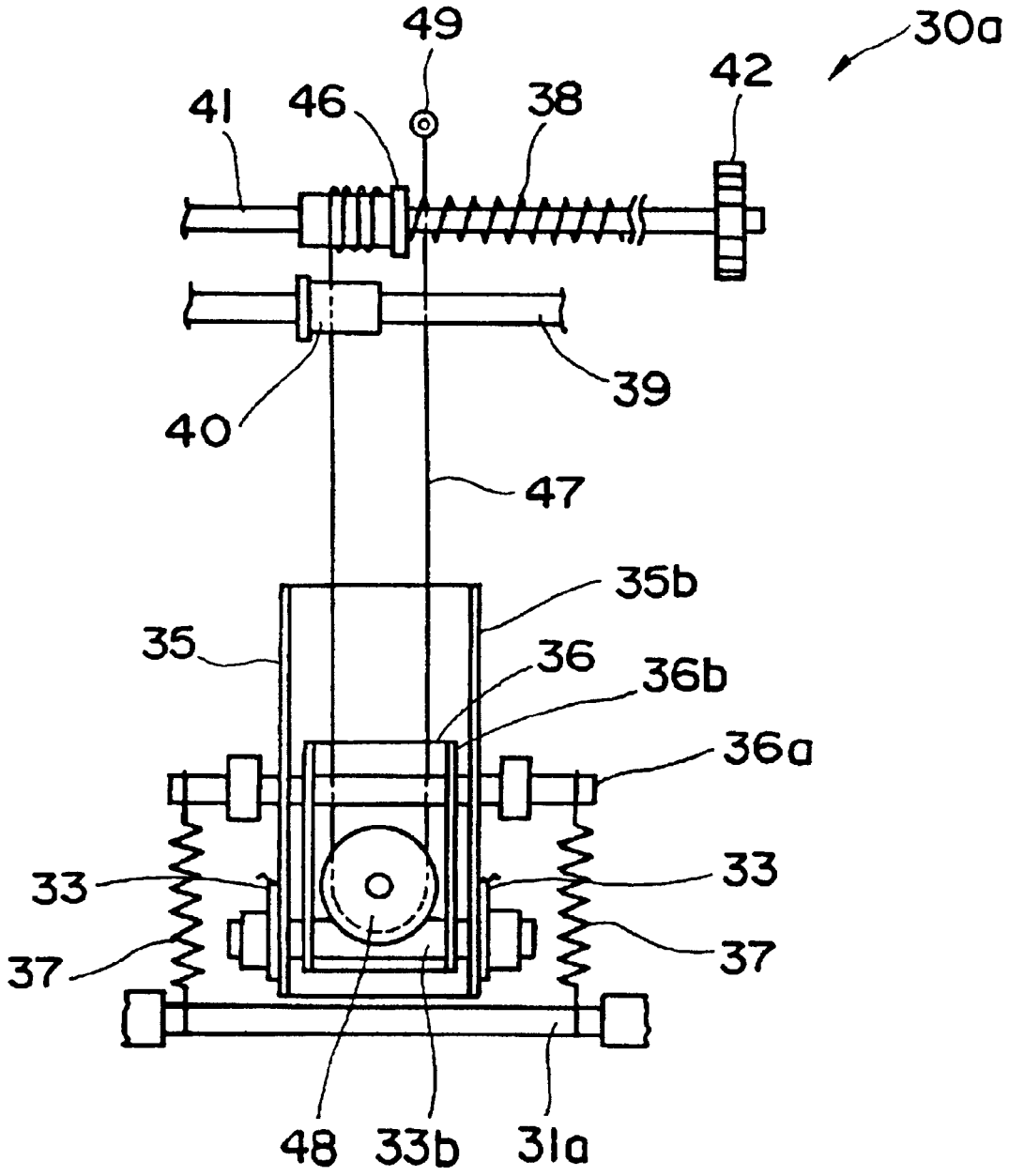
FIG. 7 is a plan view illustrating a drive mechanism of the pusher.

The fixed shaft 33*a* hingedly connects one end of the link member 33 with the pushing plate 32. The fixed shaft 33*c* hingedly connects one end of the link member 33' with the base plate 31. Rigidly secured to the base plate 31 is a bracket 35 having a pair of bent portions 35*b* each formed with an elongated hole 35*a*. As illustrated in FIG. 7, positioned inside the bent portions 35*b* of the bracket 35 is a slider 36 having a pair of bent portions 36*b*. The shafts 33*b* pass through holes formed with bent portions 36*b* and are movable within the elongated holes 35*a* of the bracket 35. The shafts 33*b* support each end of the link members 33, 33' to hingedly connects the other end of the link member 33 with the slider 36. Similarly to the shaft 33*b*, a shaft 36*a* pass through holes formed with the bent portions 36*b* of the slider 36 and are movable within the elongated holes 35*a* of the bracket 35 integrally with the shaft 33*b*. Each one end of a pair of tensile springs 37 is engaged with the shaft 36*a*, and each the other end of the tensile springs 37 is engaged with an axis 31*a* secured to the base plate 31. A pulley 48 is attached to the slider 36 for rotation. The shaft 33*d* hingedly connects the other end of the link member 33' with the pushing plate 32, and is movable along a bent edge 32*a* of the pushing plate 32.

As shown in FIGS. 5 and 7, a winding gear 42 and passive gear 44 are respectively mounted for rotation on shafts 41 and 45 supported by the base plate 31. A middle gear 43 is engaged between the gears 42 and 44 to transmit rotational force from the shaft 45 to 41. Mounted on the shaft 41 is a winding roller 46 which has an one-way clutch device (not shown) disposed between the shaft 41 and the winding roller 46.

Fixed to the winding roller 46 is one end of a tensile wire 47 which is wound around a roller 40 mounted on a shaft 39 and a pulley 48 rotatably supported on the slider 36. The other end of the wire 47 is fastened to a pin 49 fixed to the base plate 31. Wound around the shaft 41 is a twisted spring 38 both ends of which are respectively fixed to the winding roller 46 and the base plate 31 to prevent the tensile wire 47 from being loosened when the winding roller 40 is forcibly rotated.

Due to the one-way clutch device of the winding roller 46, the winding roller 46 is rotated to wind up the tensile wire 47 therearound while the shaft 41 is rotated in the reverse direction, however, the winding roller 46 is free when the shaft 41 is rotated in the forward direction and thereby the tensile wire 47 is released from the winding roller 46 because the pulley 48 together with the slider 36 is moved away from the winding roller 46 by elastic force of the tensile springs 37. As understood from FIG. 5, when the shaft 41 is rotated in the reverse direction to wind up the tensile wire 47 around the winding roller 46, the pulley 48 is pulled by the tensile wire 47 so that the slider 36 and shaft 33*b* are moved toward the winding roller 46 and therefore the pushing plate 32 stretches from the base plate 31 to the extended position within the compartment 51. Adversely, when the shaft 41 is rotated in the forward direction, the pulley 48, slider 36 and shaft 33*b* are moved away from the winding roller 46 by elastic force of the tensile spring 37 so that the pushing plate 32 is returned to the retracted position toward the base plate 31 beyond the rest position 60 of the bill 1.

When the stacker 50 is inserted into the frame 2, the passive gear 44 is brought into engagement with the end gear 26*c* so that the rotational force of the end gear 26*c* is smoothly transmitted to the passive gear 44 and hence the winding gear 42 is rotated via the middle gear 43. Thus, the link members 33, 33' are driven by the motor 25 of the conveyer 20.

If the conveyer 20 is driven by the motor 25 to carry the bill 1, the pusher 30 is inoperative due to the one-way clutch device of the winding roller 46. For that reason, the pusher plate 32 is returned to the retracted position by elastic force of the tensile springs 37 before the bill 1 supplied from the inlet 59 reaches the rest position 60 between the pusher plate 32 and back plate 54 so that the bill 1 can be pushed by the pusher 30 into the compartment 51.

A sensor (not shown) detects passage of the rear end of the bill 1 which has passed through the conveyer 20 and reached the rest position 60 within the pusher 30. In accordance with the detection signals produced by the sensor upon passage of the bill 1, the CPU generates outputs to adversely rotate the motor 25 whose driving force is transmitted through the shaft 25, gears 25*b*, 25*d*, shaft 25*c*, pulley 24*a*, endless belt 23, shaft 25*f*, gears 26*a* to 26*c*, gears 44, 43, 42, shaft 41 and winding roller 46. Thus, the winding roller 46 is rotated via the one-way clutch device of the winding roller 46 to operate the pusher 30.

Figure 8:
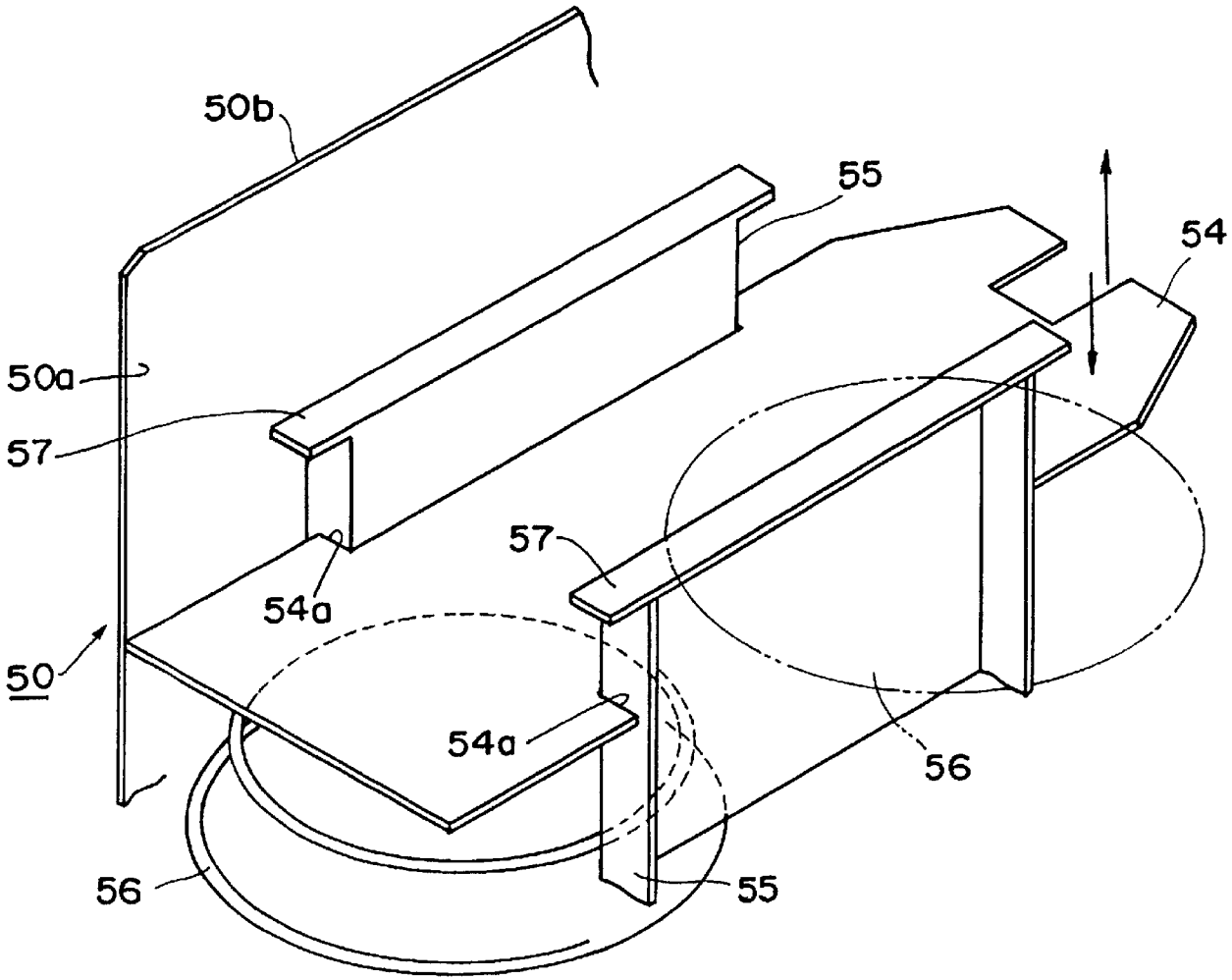
FIG. 8 is a partial perspective view of the internal construction in the stacker.

As shown in FIG. 4, a cover 52 is pivotally attached to the bottom of the encasement 50*b* by a hinge shaft 52*a* to open or close the cover 52 by rotation after unlocking operation of the locking devices 75. As shown in FIGS. 4 and 8, positioned within the compartment 51 of the stacker 50 is a back plate 54 formed with a pair of cutaways 54*a* that respectively engage with a pair of guide members. 55 respectively arranged on side walls of the encasement 50*b*. The back plate 54 may move along the guide members 55. The back plate 54 is resiliently urged by two springs 56 toward the chamber 53. A pair of stoppers 57 are formed at both ends of each guide members 55 to prevent further movement of the back plate 54 into the chamber 53 upon contact of the back plate 54 and the stoppers 57. As illustrated in FIGS. 4 and 5, the base plate 31 has a pair of aprons 31*b* which project from both edges of the base plate 31. When the pusher 30 is inserted into the encasement 50*b*, the aprons 31*b* of the base plate 31 are brought into contact with the stoppers 57 and then the pusher 30 is moved along and guided by the stoppers 57 and thereby the pusher 30 can be easily housed in the chamber 53 of the encasement 50*b*. Width of the pushing plate 32 is, slightly smaller than a distance between the guide members 55 so that the pushing plate 32 can be moved within the compartment 51 toward and away from the back plate 54.

When the bill 1 supplied from the conveyer 20 reaches the rest position 60, the pusher 30 operates to travel the pushing plate 32 toward the back plate 54, and therefore the bill 1 is pushed into the compartment 51 and upon further movement of the pushing plate 32, the bill 1 and back plate 54 are moved away from the pusher 30 against elastic force of the springs 56.

In assemblage, the pusher 30 is inserted into the stacker 50 from the opening 50*a* of the encasement 50*b* and is disposed in position upon contact of the bent portion 31*c* of the base plate 31 and the stopper 50*c* of the encasement 50*b*. Then, the stacker 50 is inserted into the frame 2 of the apparatus so that the inlet 59 of the pusher 30 is connected with the rear exit 22*b* of the guide members 22. At the same time, the passive gear 44 of the pusher 30 comes into engagement with the end gear 26*c* to transmit rotating force from the passive gear 44 to the end gear 26*c*. The shock absorbing spring 28 reduces impact force produced between the passive gear 44 to the end gear 26*c*.

In use, a bill 1 is inserted into the inlet 11 of the validator 10 and is conveyed by the belt-pulley arrangement into the validator 10 to check whether or not it is a genuine bill. When the CPU decides that the bill 1 is not a genuine bill by electric signals of physical properties of the bill 1, the belt-pulley arrangement is adversely operated to return the bill 1 to the inlet 11. When the CPU validates that the bill is a genuine bill, the belt-pulley arrangement conveys it to the connecting end 22*a* of the passageway within the conveyer 20. Then, the bill is forwarded by the endless belt 23 along the passageway toward the stacker 50 while the endless belt 23 is driven by the motor 25, however the winding pulley 46 is not rotated due to inoperative condition of the one-way clutch device when the pushing plate 32 is in the retracted position.

Subsequently, the bill 1 is supplied by the conveyer 20 through the inlet 59 into the rest position 60 of the pusher 30 and the sensor detects arrival of the bill to the rest position 60 to produce a detection signal upon which the CPU causes the motor 25 to adversely rotate. So, driving force of the endless belt 23 rotates the winding pulley 46 to wind up the wire 47, and therefore, the link members 33, 33' are stretched and the pusher plate 32 is moved from the retract to extended position. Thereby, the bill 1 in the rest position 60, is pushed into the compartment 51 to the compacted position together with the back plate 54 against elasticity of the springs 56.

After the bill 1 is pushed into the compartment 51, the motor 25 is again rotated in the forward direction and the slider 36 is pulled toward the side of the fixed axis 31*a* of the base plate 31 by restoring force of the springs 37, and then, the link members 33, 33' are retracted so that the pushing plate 32 is returned to the retracted position. At the same time, the back plate 54 is moved by restoring force of the spring 56 toward the pusher 30, and thereby the bills 1 loaded on the back plate 54 is pushed toward a pair of edges 31*c* of the pusher 30 to the rest position. This operation is repeated until a predetermined amount of the bills 1 are accumulated within the compartment 51.

When the stacker 50 is removed from the frame 2, the passive gear 44 of the pusher 30 is automatically disengaged from the middle gears 26*c* of the conveyer 20. When the cover 52 of the stacker 50 is opened, the bills 1 may be removed from the compartment 51 while the back plate 54 is moved toward the stoppers 57 along the guide members 55 by restoring force of the springs 56 until the back plate 54 makes contact with the stopper 57. When the fixing screw (not shown) for the pusher 30 is loosened and removed from the encasement 50*b*, the pusher 30 may be removed from the encasement 50*b* of the stacker 50 and attached to another stacker with an encasement of different capacity for storing bills.

Figure 9:
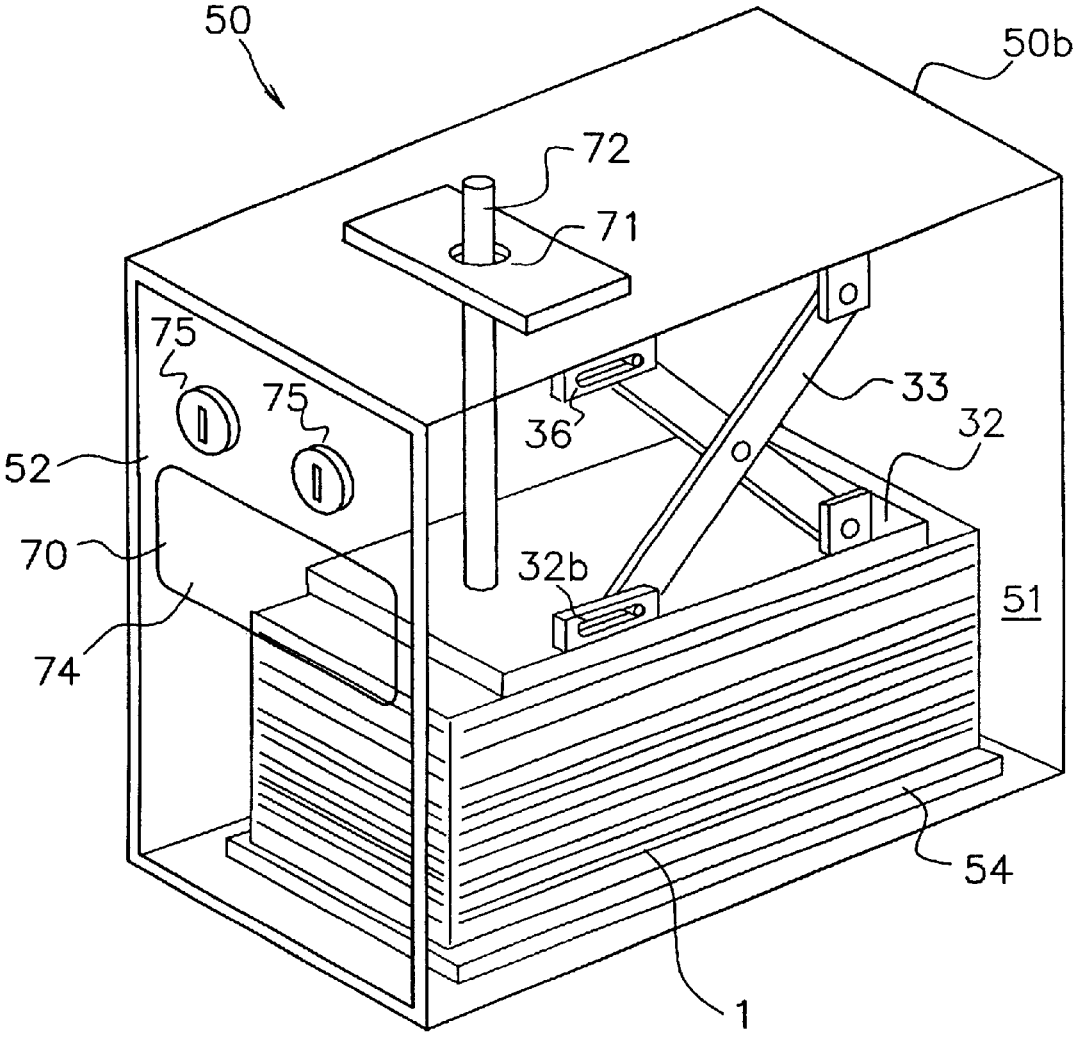
FIG. 9 is a perspective side view of the bill stacker showing an embodiment of the present invention.

FIG. 9 shows a perspective side view of the bill stacker 50. The encasement 50*b* is formed with a perforation 71 into which a rod 72 is inserted to manually move the pushing plate 32 and bills accumulated in the compartment 51 from the rest position to the compacted position against the resilient force of the spring 56. Thus, the pushing plate 32 can be downwardly moved to an appropriate position to observe and confirm the denomination of the uppermost or top bill 1 from a window 70 formed of a transparent material 73 secured to a cover 52. The operation by the rod 72 can adjust the height of the pushing plate 32 and bills 1 to visually and easily identify the denomination of the bill from the window 70. Usually, the cover 52 has more than two locking devices 75, and only the unlocking operation of these locking devices 75 allows the removal of the stacker 50 from the frame 2 and opening of the cover 52. For convenience of design, the window 70 is formed beneath the locking devices 75. When the pushing plate 32 is forcibly moved downward by the rod 72, the link members 33, 33' are extended, and the drive brackets 36 are horizontally moved toward the winding roller 46. Upon releasing the rod 72 from the pushing plate 32, the resilient force of the tension spring 37 causes the drive bracket 36 to be returned to the original position so that each link member 33, 33' are retracted and the pushing plate 32 is returned to the original retracted position. It should be noted that these operations can have no operational impact on the winding roller 46 and the driven gears 42 to 44 in the pusher 30 in driving connection with the conveyer 20, and are not hampered by the pusher 30 due to the operation of the one-way clutch device.

To confirm the denomination of the bill 1 already stacked, the stacker 50 is removed from the gaming machine 60, and the rod 72 is inserted into the perforation. 71 to move the pushing plate 32 and bill 1 downward away from the rest position toward the compacted position for easily visual observation of the top bill 1 through the window 70 of the transparent member 74 without unlocking the locking devices 75 and without opening the cover 52 in the stacker 50. Accordingly, in casinos or other gambling accommodations, the safe and easy operation can be performed to identify the bill denomination whenever the users require.

Figure 10:
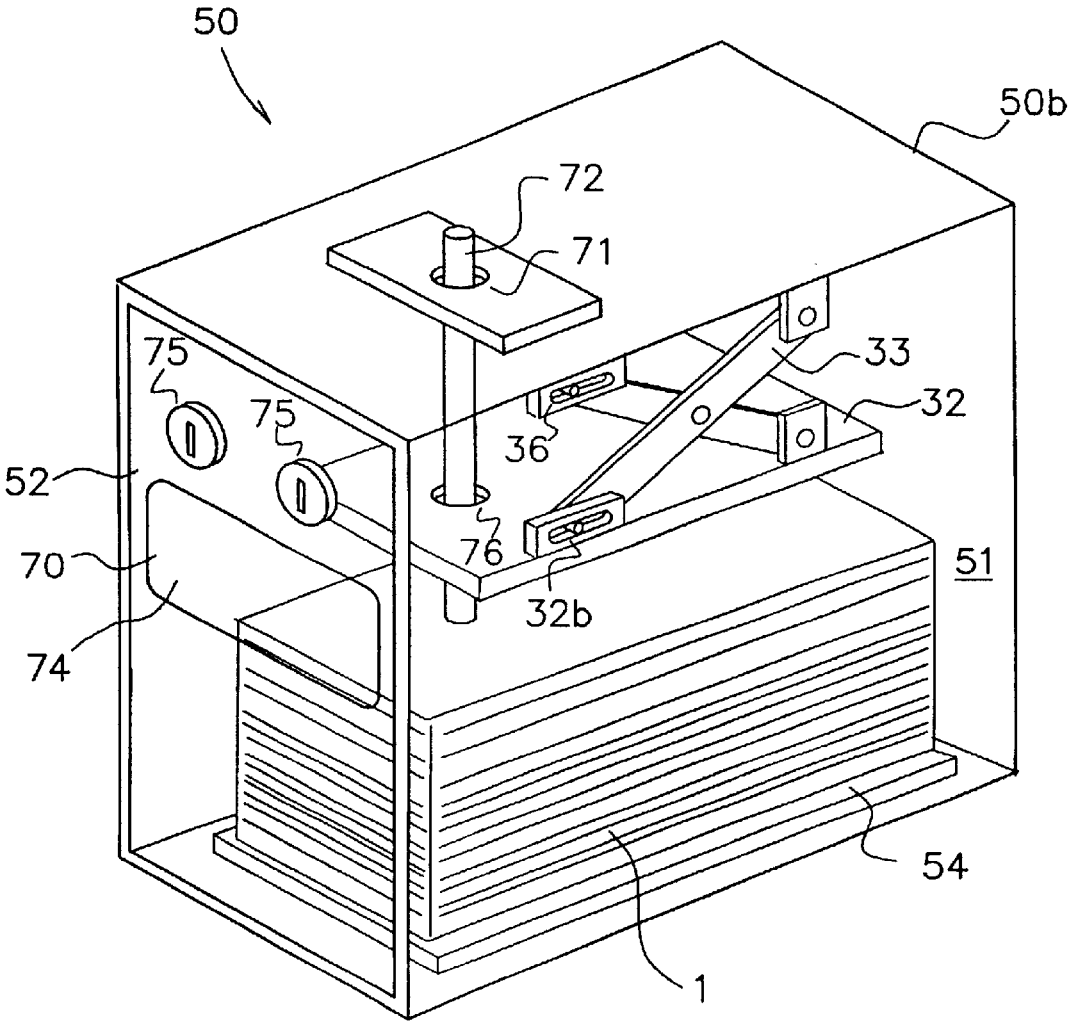
FIG. 10 is a perspective side view of the bill stacker showing a second embodiment of the present invention.
Figure 11:
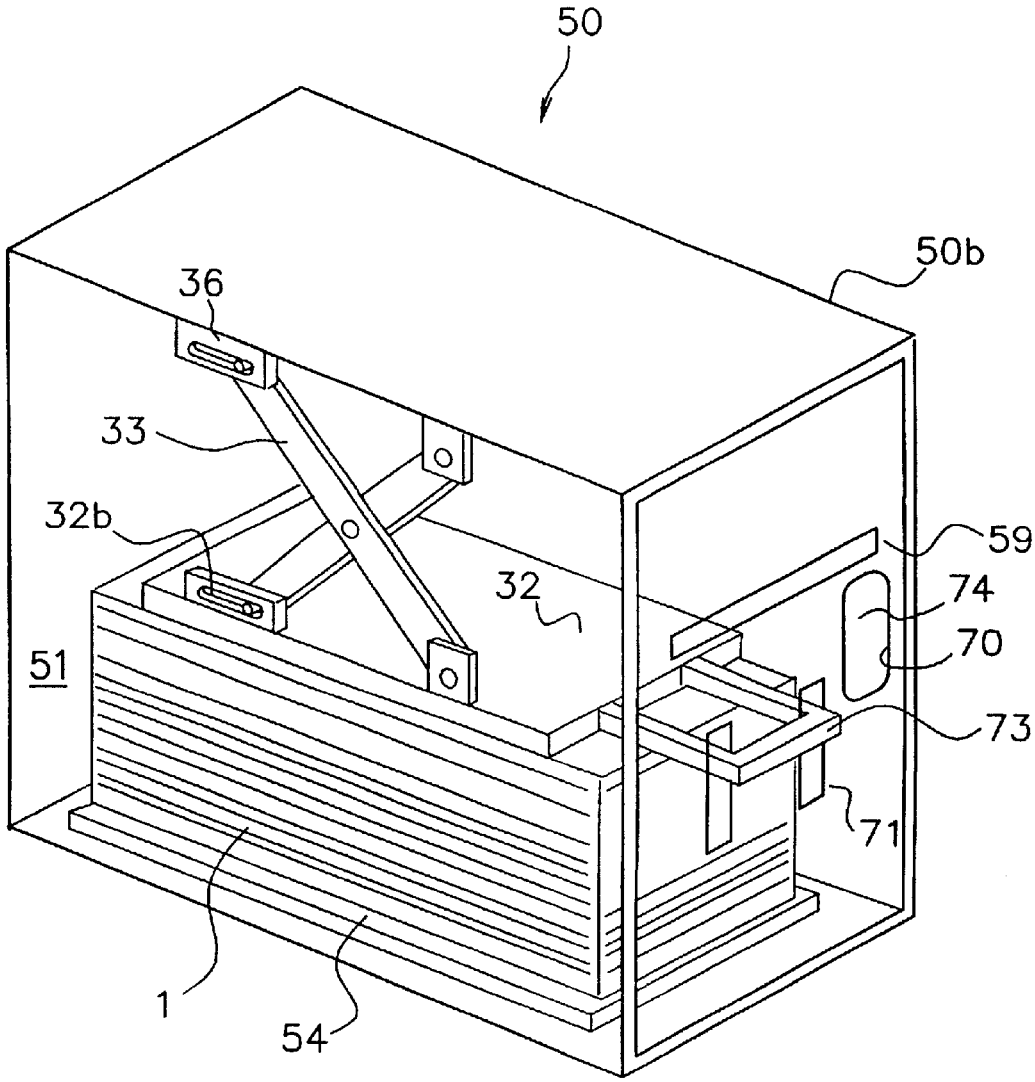
FIG. 11 is a perspective side view of the bill stacker showing a third embodiment of the present invention.
Figure 12:
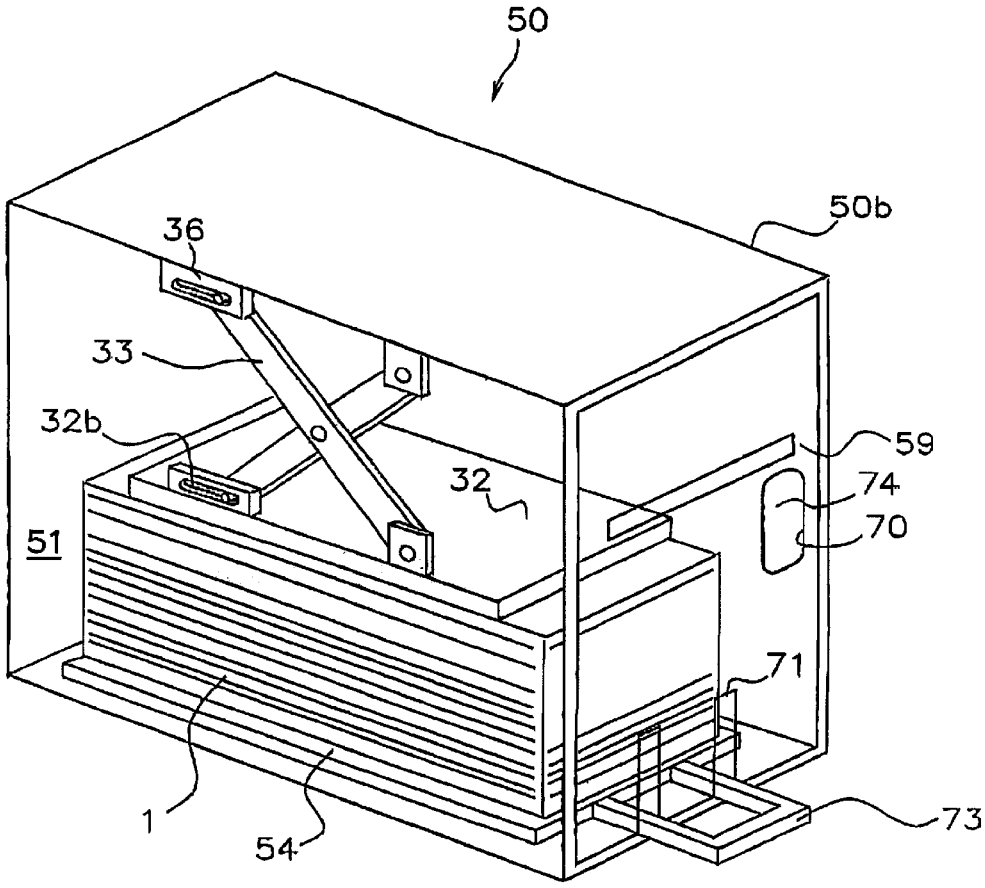
FIG. 12 is a perspective side view of the bill stacker showing a further embodiment of the present invention.

Practical embodiments and modes of the present invention may be modified in various ways without limitation to the foregoing embodiment. For example, as shown in FIG. 10, an additional opening 76 may be formed in the pushing plate 32 so that the rod 72 can be inserted from the outside through the perforation 71 and the opening 76 to move the bills 1 from the retracted position to the compacted position against the elastic force of the springs 56 so that the type of the bill 1 can more clearly be identified without movement of the pushing plate 32. In addition, as shown in FIG. 11, instead of using the rod 72 inserted from the outside, the pushing plate 32 may is formed with a handle 73 which has an inner end connected to the pushing plate 32 and an outer end protruded from the vertically elongated openings 71 so that the handle 73 can be manually moved downwardly for example from the outside of the frame 2. Otherwise, the inner end of the handle 73 may be connected to the backing plate 54 to manually move the backing plate 54 and thereby move the bills 1 away from the retracted position. The cover 52 or encasement 50*b* can be formed of a transparent material. The window 70 can be formed in the encasement 50*b* or cover 52. The transparent member 74 can be made of a plastic material or glass molded as an integral part of the cover 52 for simplified construction to prevent an unauthorized breakage of the transparent member 74.

In this way, the present invention can rapidly and safely realize the visual and easy identification of the type of the stored bill in the stacker without unlocking the lock devices.

What is claimed is:

1. A bill stacker comprising an encasement detachably attached to a frame of a bill handling apparatus for forming a compartment to store bills therein;

a cover provided in the encasement;

locking means for locking and unlocking the cover to the encasement;

a window provided in the encasement or cover;

an inlet formed in the encasement for receiving the bill from a validator of the bill handling apparatus;

a pushing device disposed in the encasement for squeezing the bill into the compartment, the pushing device having a pushing plate movable between a retracted position for receiving the bill from the inlet into a rest position of the encasement and an extended position for urging the bill into the compartment;

at least a spring for resiliently urging the bills toward the rest position in the compartment;

hole means formed in the encasement; and shifting means extending through the hole means;

wherein an external force applied on the shifting means causes the bills accumulated in the compartment to move away from the rest position against resilient force of the spring for visual observation through the window of the bill's denomination stacked at the top in the compartment without unlocking the locking means.

2. A bill stacker according to claim 1, wherein the pushing plate has its length shorter than length of the bill and its width shorter than width of the bill to show a periphery of the top bill out of the circumference of the pushing plate when the pushing plate is in contact with the top bill in the compartment.

3. A bill stacker according to claim 1, wherein said pushing devices comprises a pusher driver for moving the pushing plate from the retracted position to the extended position to squeeze into the compartment a bill conveyed in the encasement through the inlet.

4. A bill stacker according to claim 1, wherein the shifting means is a rod or bar which can be inserted from the outside through the hole means of a perforation formed in the encasement.

5. A bill stacker according to claim 3, wherein the shifting means is a handle which has an inner end connected to the pushing plate, and an outer end protruding out of the encasement through the hole means of a perforation.

6. A bill stacker according to claim 2, wherein a backing plate is provided between the spring and bills, and the shifting means is a handle which has an inner end connected to the backing plate and an outer end protruding out of the encasement through the hole means of a perforation.

7. A bill stacker according to claim 1, wherein a one-way clutch device is provided in the pushing device to carry out manual operation of the shifting means so that the bill is moved away from the rest position toward a compacted position together with the shifting means.

8. A bill stacker according to claim 3, wherein the window is formed with a transparent member vertically spaced from the locking means provided in the cover of the encasement.

9. A bill stacker according to claim 3, wherein said pushing plate is formed with an opening in alignment with the hole means through which the shifting means can be extended to move the bills away from the rest position.

* * * * *